US011255259B2

(12) United States Patent
Makartchouk

(10) Patent No.: US 11,255,259 B2
(45) Date of Patent: Feb. 22, 2022

(54) ENGINE WITH VARIABLE COMPRESSION RATIO

(71) Applicant: International Engine Intellectual Property Company, LLC, Lisle, IL (US)

(72) Inventor: Andrei Makartchouk, Hinsdale, IL (US)

(73) Assignee: International Engine Intellectual Property Company, LLC., Lisle, IL (US)

( * ) Notice: Subject to any disclaimer, the term of this patent is extended or adjusted under 35 U.S.C. 154(b) by 0 days.

(21) Appl. No.: 16/529,226

(22) Filed: Aug. 1, 2019

(65) Prior Publication Data

US 2021/0033023 A1 Feb. 4, 2021

(51) Int. Cl.
*F02B 75/04* (2006.01)
*F02D 15/02* (2006.01)

(52) U.S. Cl.
CPC ..... *F02B 75/044* (2013.01); *F02D 15/02* (2013.01)

(58) Field of Classification Search
CPC ..... F02B 75/044; F02D 15/02
See application file for complete search history.

(56) References Cited

U.S. PATENT DOCUMENTS

| | | | | |
|---|---|---|---|---|
| 7,168,396 | B1 | 3/2007 | Bulicz | |
| 2011/0192371 | A1* | 8/2011 | Satou | F16F 15/24 123/197.4 |
| 2013/0327302 | A1* | 12/2013 | Hiyoshi | F02B 75/048 123/48 R |
| 2014/0014070 | A1* | 1/2014 | Lee | F02B 75/047 123/48 B |
| 2017/0167370 | A1* | 6/2017 | Choi | F02B 75/048 |

* cited by examiner

*Primary Examiner* — Kevin A Lathers
(74) *Attorney, Agent, or Firm* — Jack D. Nimz; Mark C. Bach

(57) ABSTRACT

A compression ratio varying arrangement of an engine is adapted to work with a crankshaft having at least one crankpin offset from the centerline of the crankshaft. An eccentric has an internal bore engaged with the crankpin, and an external cylindrical surface that has a centerline that is offset from the centerline of the internal bore. A connecting rod is engaged with the external cylindrical surface of the eccentric, and a piston is connected to the connecting rod. An eccentric lever is attached to the eccentric. A compression ratio adjustment link is connected to the eccentric lever. A compression ratio adjustment mechanism is connected to the compression ratio adjustment link. The compression ratio adjustment mechanism controls the orientation of the connecting rod eccentric, and thereby the compression ratio of the engine, by extending or retracting the compression ratio adjustment link.

20 Claims, 5 Drawing Sheets

ENGINE WITH VARIABLE COMPRESSION RATIO

BACKGROUND

This disclosure relates to engines, and in particular to engines for commercial ground vehicles, in which the compression ratio may be varied in order to improve overall efficiency. Further, it relates to a mechanism for varying the compression ratio in such engines, and a method for the use thereof.

RELATED ART

Technical data illustrates that fuel efficiency of engines having the capability to provide a variable compression ratio are higher than engines having a fixed compression ratio. It is known that engines having the capability to provide a variable compression ratio may achieve increases in fuel efficiency of between 18 and 27 percent. However, known engines having the capability to provide a variable compression ratio also typically require several additional links and joints in the linkage between the crankshaft and the piston. Each such link and joint adds to the manufacturing complexity of the engine, increases the number of potential failure points of the linkage, and increases the overall friction of the linkage. Furthermore, known engines having the capability to provide a variable compression ratio are typically bulky due to the additional links and joints. These additional reciprocating links and joints between the crankshaft and the piston of known engines having the capability to provide a variable compression ratio also add inertia to the reciprocating and/or rotating mass, and require extensive balancing in order to function. Such increase in the inertia of reciprocating and/or rotating engine components thereby limits the efficiency increase of known engines having the capability to provide a variable compression ratio.

For example, Infiniti, the luxury vehicle division of automaker Nissan, has developed a turbocharged 2.0 liter gasoline engine equipped with a variable compression ratio system. The linkage is actuated by an electric stepper motor, which rotates a lower camshaft. The camshaft moves a linkage rod that attaches to and positions a three-hole lever arm. The center hole of the three-hole lever arm engages the crankshaft, and the hole opposite from the linkage rod attaches to the connecting rod. Moving the linkage rod up and down thereby lowers and raises the connecting rod, respectively, thereby varying the compression ratio. While this design has accomplished some increase in fuel efficiency, the multi-linkage variable compression ratio system is not compact, results in greatly increased inertial forces due to the additional reciprocating parts, and requires extensive engine balancing.

Accordingly, there is an unmet need for an arrangement and method for varying the compression ratio of an engine while reducing the number of additional joints in the linkage between the crankshaft and the piston, in order to reduce inertial forces, minimize required engine balancing, reduce part cost, and maximize overall efficiency. There is also an unmet need for an arrangement and method for varying the compression ratio of an engine within a compact package, in order to facilitate installation.

SUMMARY

According to one embodiment of the Engine with Variable Compression Ratio, a vehicle has an engine. The engine includes a crankshaft having at least one crankpin offset from the centerline of the crankshaft. A connecting rod eccentric has an eccentric internal bore engaged with the at least one crankpin. The connecting rod eccentric also has an eccentric external cylindrical surface. The eccentric external cylindrical surface has a centerline that is offset from the centerline of the eccentric internal bore. A connecting rod is engaged with the eccentric external cylindrical surface of the connecting rod eccentric, and a piston is connected to the connecting rod. An eccentric lever is attached to the connecting rod eccentric. A compression ratio adjustment link is connected to the eccentric lever. A compression ratio adjustment mechanism is connected to the compression ratio adjustment link.

According to another embodiment of the Engine with Variable Compression Ratio, an engine of a vehicle has a crankshaft having at least one crankpin offset from the centerline of the crankshaft. A connecting rod eccentric has an eccentric internal bore engaged with the at least one crankpin. The connecting rod eccentric also has an eccentric external cylindrical surface. The eccentric external cylindrical surface has a centerline that is offset from the centerline of the eccentric internal bore. A connecting rod is engaged with the eccentric external cylindrical surface of the connecting rod eccentric, and a piston is connected to the connecting rod. An eccentric lever is attached to the connecting rod eccentric. A compression ratio adjustment link is connected to the eccentric lever. A compression ratio adjustment mechanism is connected to the compression ratio adjustment link.

According to another embodiment of the Engine with Variable Compression Ratio, a method for varying the compression ratio of an engine includes several steps. The first step is providing a crankshaft having at least one crankpin offset from the centerline of the crankshaft. The second step is engaging an eccentric internal bore of a connecting rod eccentric with the at least one crankpin, the connecting rod eccentric further having an eccentric external cylindrical surface, the eccentric external cylindrical surface having a centerline that is offset from the centerline of the eccentric internal bore. The third step is engaging a connecting rod with the eccentric external cylindrical surface of the connecting rod eccentric. The fourth step is connecting a piston to the connecting rod. The fifth step is attaching an eccentric lever to the connecting rod eccentric. The sixth step is connecting a compression ratio adjustment link to the eccentric lever. The seventh step is connecting a compression ratio adjustment mechanism to the compression ratio adjustment link.

DETAILED DESCRIPTION

Figure 1:
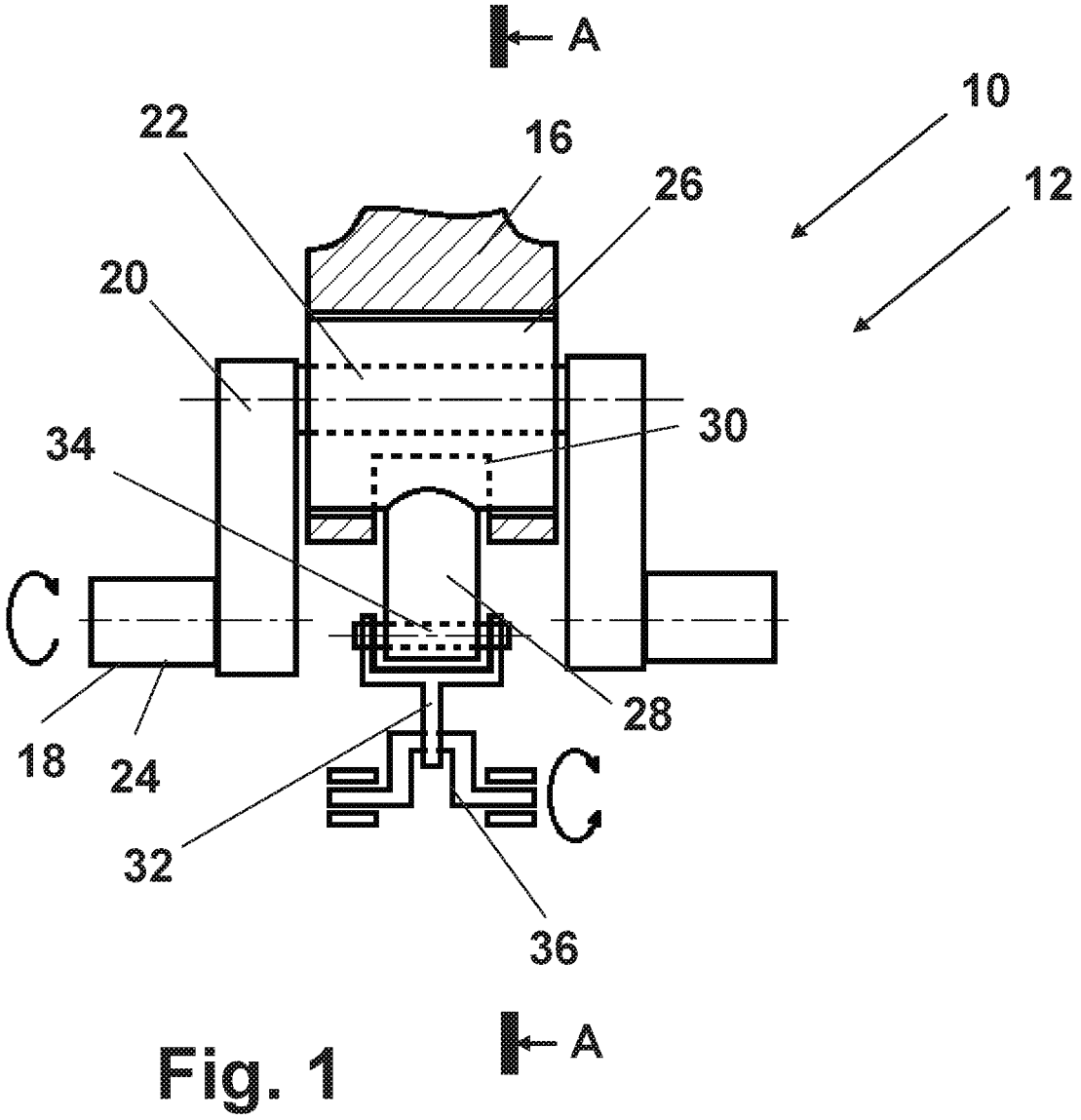
FIG. 1 is a side view of an embodiment of the Engine with Variable Compression Ratio according to the present disclosure, as described herein.

Embodiments described herein relate to an Engine with Variable Compression Ratio and methods for the use thereof. The engine and its method of use may be applied to engines used in various types of stationary applications, marine applications, passenger vehicles, and commercial vehicles and recreational vehicles, such as highway or semi-tractors, straight trucks, busses, fire trucks, agricultural vehicles, motorhomes, rail travelling vehicles, and etcetera. It is further contemplated that embodiments of the Engine with Variable Compression Ratio and methods for the use thereof may be applied to engines configured for various fuels, such as gasoline, diesel, propane, natural gas, and hydrogen, as non-limiting examples. The several embodiments of the Engine with Variable Compression Ratio and method for the use thereof presented herein are employed on vehicles utilizing the Otto cycle or the Diesel cycle, but this is not to be construed as limiting the scope of the engine and its method of use, which may be applied to engines of differing construction.

Embodiments of the Engine with Variable Compression Ratio and methods for the use thereof disclosed herein vary the compression ratio of the engine by varying the Top Dead Center (TDC) position of the piston while utilizing a minimum of additional links and joints in the linkage between the crankshaft and the piston. By controllably adjusting the compression ratio, embodiments of the Engine with Variable Compression Ratio of the present disclosure increase their overall fuel efficiency as compared to engines of conventional construction. This results in reduced fuel consumption and reduced Green House Gas (GHG) emissions.

The Engine with Variable Compression Ratio utilizes a compression ratio varying arrangement having a connecting rod eccentric interposed between the crankpin of a crankshaft and the connecting rod internal bore of a connecting rod of a reciprocating internal combustion engine in order to vary the compression ratio of the reciprocating internal combustion engine. The centerline of the internal bore of the connecting rod eccentric, which engages with the crankpin, is offset or non-concentric from the centerline of the external cylindrical surface of the connecting rod eccentric, which engages with the connecting rod internal bore of the connecting rod. The orientation of the connecting rod eccentric, and thus the compression ratio of the reciprocating internal combustion engine, is controlled by an eccentric lever, which is firmly attached to the connecting rod eccentric and extends through a connecting rod window on the bottom end of the connecting rod. A compression ratio adjustment mechanism, which may be connected to and controlled by a controller such as an engine controller, is connected to the eccentric lever by way of a compression ratio adjustment link, and controls the orientation of the connecting rod eccentric by extending or retracting the compression ratio adjustment link.

The compression ratio adjustment mechanism may be embodied as a crank that is rotated in order to extend or retract the compression ratio adjustment link, or may alternately be embodied as a hydraulic actuator, a pneumatic actuator, or an electrical actuator, as non-limiting examples. The compression ratio varying arrangement may be arranged so that the compression ratio adjustment link and compression ratio adjustment mechanism are on the same side of the compression ratio varying arrangement as the centerline of the eccentric external cylindrical surface is offset from the centerline of the eccentric internal bore, or may be arranged so that the compression ratio adjustment link and compression ratio adjustment mechanism are on the opposite side of the compression ratio varying arrangement from the offset of the centerline of the eccentric external cylindrical surface with respect to the centerline of the eccentric internal bore. That is to say that the compression ratio of the internal combustion engine may be increased by the compression ratio adjustment mechanism extending or retracting the compression ratio adjustment link, depending on whether the compression ratio adjustment link and compression ratio adjustment mechanism are on the opposite side or same side of the compression ratio varying arrangement as the centerline of the eccentric external cylindrical surface is offset from the centerline of the eccentric internal bore, respectively.

The Engine with Variable Compression Ratio using embodiments of the compression ratio varying arrangement according to the present disclosure results in an engine having variable compression ratio capability in a more compact arrangement with fewer additional links and joints, lower inertial forces, and reduced balancing requirements over existing designs. This results in increased fuel combustion efficiency, decreased fuel consumption, and decreased exhaust emissions.

Figure 2:
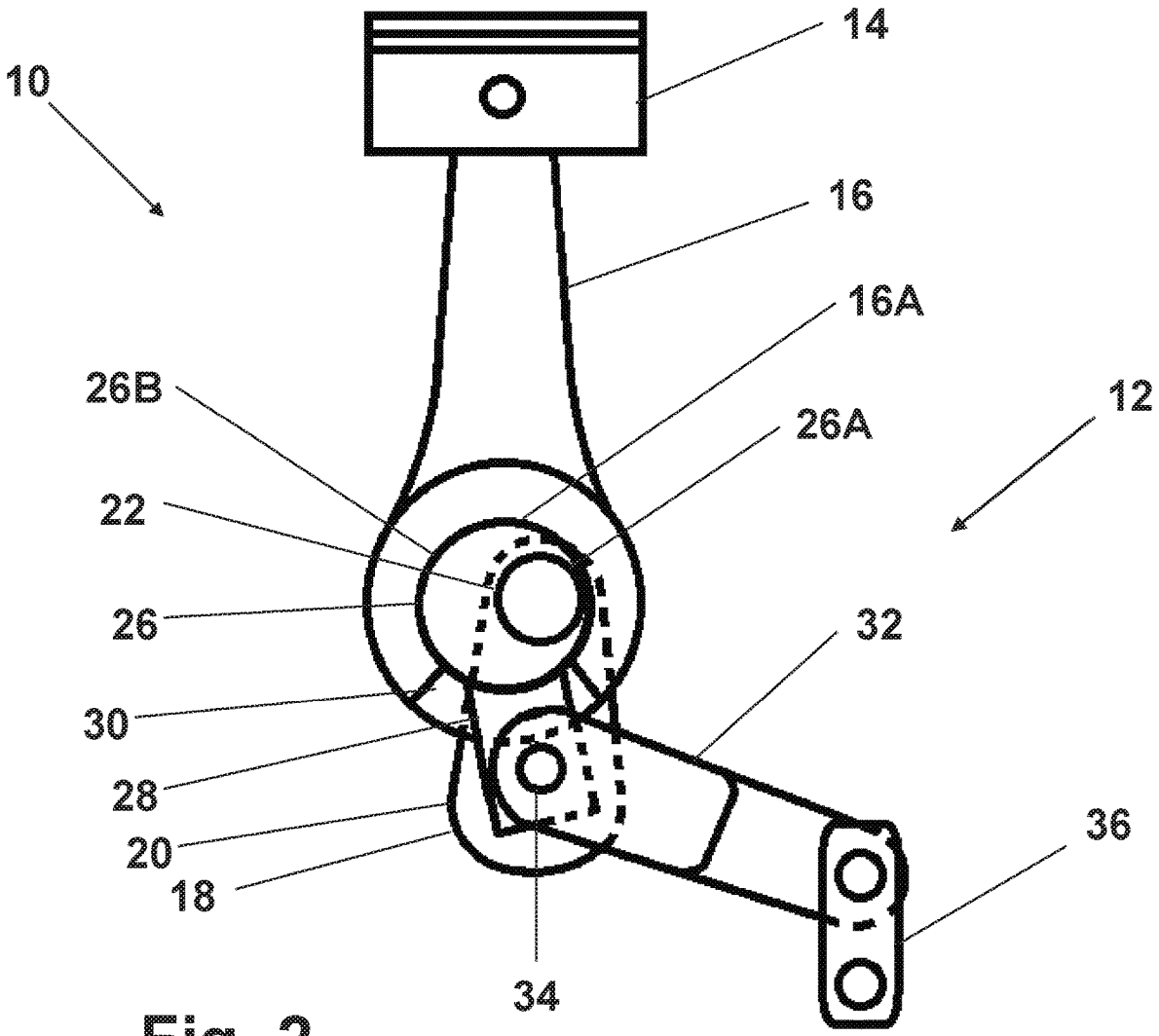
FIG. 2 is an end view of an embodiment of the Engine with Variable Compression Ratio according to the present disclosure, as described herein.

Turning now to FIGS. 1 and 2, an embodiment of an Engine with Variable Compression Ratio 10 having a compression ratio varying arrangement 12 according to the present disclosure is shown in a side view and in a front view, respectively. The Engine with Variable Compression Ratio 10 is provided with at least one piston 14 reciprocally connected to a rotatable crankshaft 18 by way of one connecting rod 16 for each piston 14. In FIG. 1, for the sake of illustration, the connecting rod 16 is shown in partial cutaway view, and the piston 14 is not shown. The crankshaft 18 rotates on at least one main journal 24 and has at least one crankpin 22. The at least one crankpin 22 has an axis that is offset from the at least one main journal 24 by a crank throw distance, which is defined by at least one crankshaft cheek 20 that connects the at least one crankpin 22 to the at least one main journal 24.

In lieu of the usual direct engagement between the crankpin 22 and an internal bore 16A of the connecting rod 16, the compression ratio varying arrangement 12 of the Engine with Variable Compression Ratio 10 is provided with a connecting rod eccentric 26 interposed between the crankpin 22 and the internal bore 16A of the connecting rod 16. The connecting rod eccentric 26 is provided with an eccentric lever 28, which extends through a connecting rod window 30 of the connecting rod 16 and is connected to a compression ratio adjustment link 32. The compression ratio adjustment link 32 is in turn connected to a compression ratio adjustment mechanism 36 by way of a compression ratio adjustment link to eccentric lever connecting pin 34. The connecting rod eccentric 26 is provided with an eccentric internal bore 26A that is offset or non-concentric from the centerline of the eccentric external cylindrical surface 26B of the connecting rod eccentric 26. The eccentric internal bore 26A is engaged with the crankpin 22. The eccentric external cylindrical surface 26B of the connecting rod eccentric 26 is engaged with the connecting rod internal bore 16A of the connecting rod 16.

As may be seen in FIG. 1 the connecting rod has a first side (the right side surface as shown in FIG. 1) and a second side (the left side surface as shown in FIG. 1). Thus a first plane is defined by the first side of the connecting rod 16 and a second plane is defined by the second side of the connecting rod 16.

Figure 3:
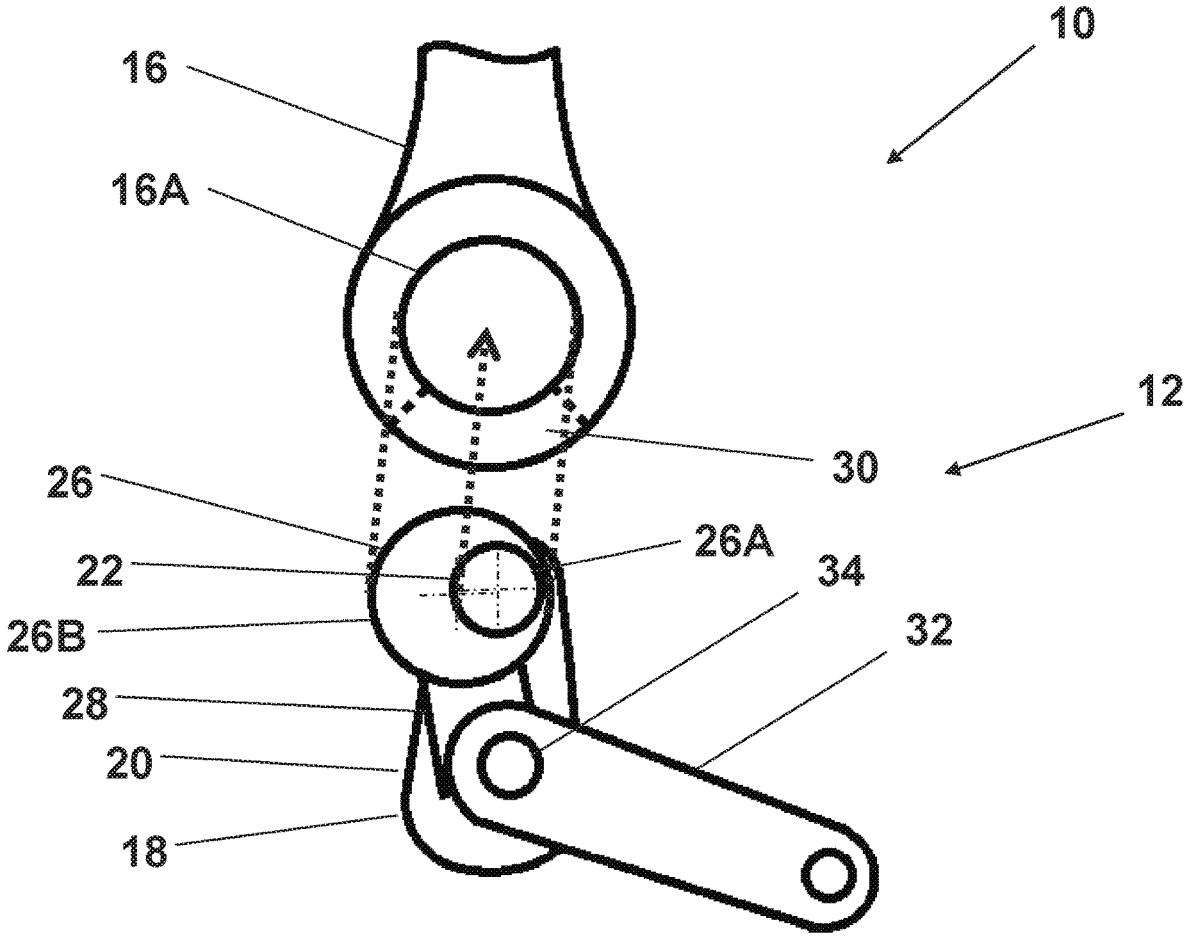
FIG. 3 is an end view of an embodiment of a compression ratio varying arrangement of the Engine with Variable Compression Ratio according to the present disclosure, as described herein.
Figure 4:
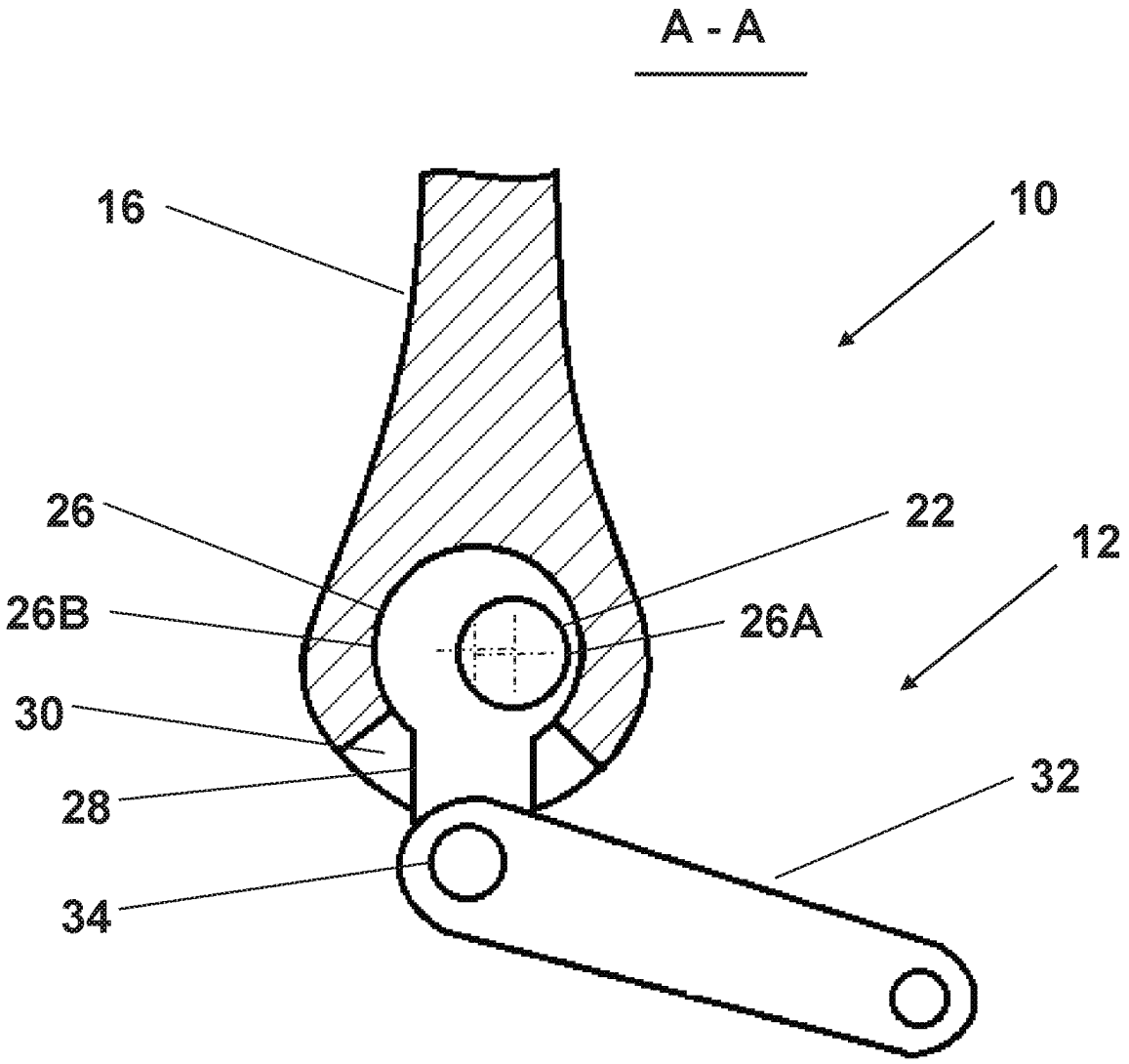
FIG. 4 is an end view of an embodiment of a compression ratio varying arrangement of the Engine with Variable Compression Ratio according to the present disclosure, as described herein.
Figures 5A, 5B:
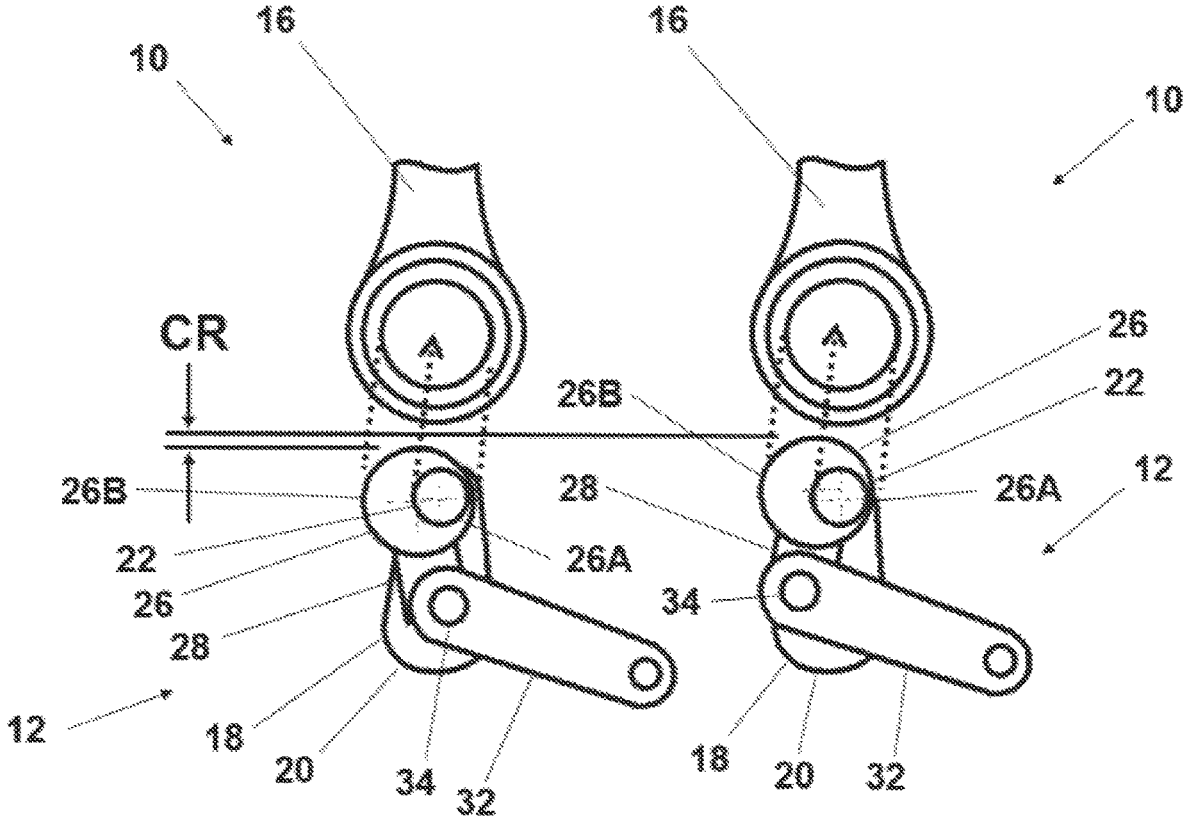
FIG. 5A is an end view of an embodiment of a compression ratio varying arrangement of the Engine with Variable Compression Ratio according to the present disclosure, as described herein.
FIG. 5B is an end view of an embodiment of a compression ratio varying arrangement of the Engine with Variable Compression Ratio according to the present disclosure, as described herein.

FIGS. 3, 4, 5A, and 5B again show front views of the engine with variable compression ratio 10 having a compression ratio varying arrangement 12 according to the present disclosure. FIGS. 3, 5A, and 5B show the compression ratio varying arrangement 12 removed from the connecting rod 16 for the sake of illustration. FIG. 4 shows the compression ratio varying arrangement 12 installed in the connecting rod 16, which connecting rod 16 is shown in sectioned view. A crankshaft 18 (not shown in FIG. 4) again has at least one main journal 24 (not shown) and at least one crankpin 22 connected to the at least one main journal 24 by way of at least one crankshaft cheek 20 (not shown in FIG. 4). The at least one crankpin 22 again has an axis that is offset from the at least one main journal 24 by a crank throw distance, which is defined by the at least one crankshaft cheek 20 that connects the at least one crankpin 22 to the at least one main journal 24.

A connecting rod eccentric 26 again has an eccentric internal bore 26A that is engaged with the crankpin 22. The connecting rod eccentric 26 again has an eccentric lever 28, which extends through a connecting rod window 30 of the connecting rod 16 when the eccentric external cylindrical surface 26B of the connecting rod eccentric 26 is inserted into the connecting rod internal bore 16A of the connecting rod 16, as shown in FIG. 4. The centerline of the eccentric internal bore 26A of the connecting rod eccentric 26 is again offset or non-concentric from the centerline of the eccentric external cylindrical surface 26B of the connecting rod eccentric 26. A compression ratio adjustment link 32 is again connected to the eccentric lever 28 by way of a compression ratio adjustment link to eccentric lever connecting pin 34. As before, the eccentric internal bore 26A is engaged with the crankpin 22, and the eccentric external cylindrical surface 26B of the connecting rod eccentric 26 is engaged with the connecting rod internal bore 16A of the connecting rod 16.

When it is desired to increase the compression of the embodiment of the Engine with Variable Compression Ratio 10 shown in the Figures, the compression ratio adjustment mechanism 36 extends or urges the compression ratio adjustment link 32 towards the centerline of the crankshaft 18. In the embodiment of the compression ratio adjustment mechanism 36 shown in FIG. 2, wherein the compression ratio adjustment mechanism 36 takes the form of a crank, this may be accomplished by rotating the crank counterclockwise. However, other embodiments of the compression ratio adjustment mechanism 36 are contemplated as part of the present disclosure, such as a hydraulic actuator, a pneumatic actuator, or an electrical actuator, as non-limiting examples, provided that such other embodiment of the compression ratio adjustment mechanism 36 acts to move the compression ratio adjustment link 32.

As shown in FIGS. 5A and 5B, when the compression ratio adjustment link 32 is extended or urged toward the centerline of the crankshaft 18, it causes the connecting rod eccentric 26 to rotate clockwise about the crankpin 22 by way of the eccentric lever 28, for a given position of the crankshaft 18. As the centerline of the eccentric internal bore 26A of the connecting rod eccentric 26 is offset or non-concentric from the centerline of the eccentric external cylindrical surface 26B, the centerline of the eccentric external cylindrical surface 26B rotates about the crankpin 22 and is raised vertically relative to the crankpin 22 by an amount "CR". Therefore, the connecting rod 16 is raised by amount CR at the top dead center position of the crankshaft, and the compression ratio of the piston 14 (not shown) in its cylinder (not shown) is increased. Conversely, when the compression ratio adjustment link 32 is retracted or urged away from the centerline of the crankshaft 18, it causes the connecting rod eccentric 26 to rotate counterclockwise about the crankpin 22, for a given position of the crankshaft 18. The centerline of the eccentric external cylindrical surface 26B rotates about the crankpin 22 and is lowered vertically relative to the crankpin 22. Therefore, the connecting rod 16 is lowered at the top dead center position of the crankshaft, and the compression ratio of the piston 14 (not shown) in its cylinder (not shown) is decreased.

Each of FIGS. 1, 2, 3, 4, 5A, and 5B show the compression ratio varying arrangement 12 arranged with the compression ratio adjustment link 32 extending from the eccentric lever 28 on the left to the compression ratio adjustment mechanism 36 on the right, and with the centerline of the eccentric external cylindrical surface 26B to the left of the centerline of the eccentric internal bore 26A. However, it is contemplated that the compression ratio adjustment link 32 extends from the eccentric lever 28 on the right to the compression ratio adjustment mechanism 36 on the left, and the centerline of the eccentric external cylindrical surface 26B is to the right of the centerline of the eccentric internal bore 26A. Further, the compression ratio varying arrangement 12 may be arranged so that the compression ratio adjustment link 32 and compression ratio adjustment mechanism 36 are on the same side of the compression ratio varying arrangement 12 as the centerline of the eccentric external cylindrical surface 26B is offset from the centerline of the eccentric internal bore 26A. In the latter case, when the compression ratio adjustment link 32 is retracted or urged away from the centerline of the crankshaft 18, it causes the connecting rod eccentric 26 to rotate about the crankpin 22 and raise vertically relative to the crankpin 22. Therefore, the connecting rod 16 is raised at the top dead center position of the crankshaft, and the compression ratio of the piston 14 in its cylinder is increased.

The compression ratio adjustment mechanism 36 may be connected to and controlled by a controller (not shown), which may be an engine controller. When it is advantageous to increase compression in order to improve engine efficiency, the engine controller causes the compression ratio adjustment mechanism 36 to extend or retract the compression ratio adjustment link 32, depending on the configuration of the compression ratio varying arrangement 12, in order to rotate the connecting rod eccentric 26 by way of the eccentric lever 28, thereby raising the centerline of the eccentric external cylindrical surface 26B relative to the crankpin 22. This, in turn, raises the connecting rod 16 and piston 14 relative to the crankshaft 18, for a given position of the crankshaft 18, and in particular raises the connecting rod 16 and piston 14 when the crankshaft 18 is at its top dead center position. When it is advantageous to decrease compression in order to increase power output, the engine controller causes the compression ratio adjustment mechanism 36 to retract or extend the compression ratio adjustment link 32, again depending on the configuration of the compression ratio varying arrangement 12, in order to rotate the connecting rod eccentric 26 by way of the eccentric lever 28, thereby lowering the centerline of the eccentric external cylindrical surface 26B relative to the crankpin 22. This, in turn, lowers the connecting rod 16 and piston 14 relative to the crankshaft 18, for a given position of the crankshaft 18, and in particular lowers the connecting rod 16 and piston 14 when the crankshaft 18 is at its top dead center position.

It is contemplated that the compression ratio adjustment mechanism 36 may remain stationary throughout rotation of the crankshaft 18 for a given compression ratio setting. Alternately, the compression ratio adjustment mechanism 36 may itself rotate or articulate in synchronous or non-synchronous relation to the rotation of the crankshaft 18 within a given compression ratio setting.

While the Engine with Variable Compression Ratio, and methods for the use thereof, has been described with respect to at least one embodiment, the engine and its method of use can be further modified within the spirit and scope of this disclosure, as demonstrated previously. This application is therefore intended to cover any variations, uses, or adaptations of the system and method using its general principles. Further, this application is intended to cover such departures from the present disclosure as come within known or customary practice in the art to which the disclosure pertains and which fall within the limits of the appended claims.

What is claimed is:

1. A vehicle having an engine with a variable compression ratio, comprising:

a crankshaft having at least one crankpin offset from the centerline of the crankshaft;

a connecting rod eccentric having an eccentric internal bore engaged with the at least one crankpin, the connecting rod eccentric further having an eccentric external cylindrical surface, the eccentric external cylindrical surface having a centerline that is offset from the centerline of the eccentric internal bore;

a connecting rod engaged with the eccentric external cylindrical surface of the connecting rod eccentric, and a piston connected to the connecting rod;

an eccentric lever attached to the connecting rod eccentric;

a compression ratio adjustment link connected to the eccentric lever; and a compression ratio adjustment mechanism connected to the compression ratio adjustment link;

wherein the connecting rod eccentric is fully disposed within the eccentric internal bore; and the connecting rod has a connecting rod window through which the eccentric lever may move upon rotation of the eccentric lever about the centerline of the eccentric internal bore.

2. The vehicle of claim 1, wherein:

the connecting rod eccentric is fully disposed between a first side of the connecting rod and a second side of the connecting rod.

3. The vehicle of claim 1, wherein:

the eccentric lever remains fully disposed between the plane defined by the first side of the connecting rod and the second side of the connecting rod throughout rotational movement of the eccentric lever about the centerline of the eccentric internal bore.

4. The vehicle of claim 1, wherein:

the compression ratio adjustment mechanism moves the centerline of the eccentric internal bore closer toward and further away from the piston.

5. The vehicle of claim 1, wherein:

the compression ratio adjustment mechanism further comprises a crank that is rotated in order to extend or retract the compression ratio adjustment link.

6. The vehicle of claim 1, wherein:

the compression ratio adjustment link and the compression ratio adjustment mechanism are on the opposite side of the crankshaft from the offset of the centerline of the eccentric external cylindrical surface with respect to the centerline of the eccentric internal bore.

7. An engine with a variable compression ratio, comprising:

a crankshaft having at least one crankpin offset from the centerline of the crankshaft;

a connecting rod eccentric having an eccentric internal bore engaged with the at least one crankpin, the connecting rod eccentric further having an eccentric external cylindrical surface, the eccentric external cylindrical surface having a centerline that is offset from the centerline of the eccentric internal bore;

a connecting rod engaged with the eccentric external cylindrical surface of the connecting rod eccentric, and a piston connected to the connecting rod;

an eccentric lever attached to the connecting rod eccentric;

a compression ratio adjustment link connected to the eccentric lever;

a compression ratio adjustment mechanism connected to the compression ratio adjustment link; and the connecting rod eccentric being fully disposed between a first side of the connecting rod and a second side of the connecting rod.

8. The engine of claim 7, wherein:

the connecting rod has a connecting rod window through which the eccentric lever extends.

9. The engine of claim 8, wherein:

the eccentric lever remains fully disposed between the plane defined by the first side of the connecting rod and the plane defined by the second side of the connecting rod throughout movement of the eccentric lever.

10. The engine of claim 9, wherein:

the compression ratio adjustment mechanism controls the orientation of the connecting rod eccentric by extending or retracting the compression ratio adjustment link.

11. The engine of claim 10, wherein:

the compression ratio adjustment mechanism further comprises a crank that is rotated in order to extend or retract the compression ratio adjustment link.

12. The engine of claim 7, wherein:

the compression ratio adjustment link and the compression ratio adjustment mechanism are on the opposite side of the crankshaft from the offset of the centerline of the eccentric external cylindrical surface with respect to the centerline of the eccentric internal bore.

13. A method for varying the compression ratio of an engine, comprising the steps of:

providing a crankshaft having at least one crankpin offset from the centerline of the crankshaft;

engaging an eccentric internal bore of a connecting rod eccentric with the at least one crankpin, the connecting rod eccentric further having an eccentric external cylindrical surface, the eccentric external cylindrical surface having a centerline that is offset from the centerline of the eccentric internal bore;

engaging a connecting rod with the eccentric external cylindrical surface of the connecting rod eccentric, and connecting a piston to the connecting rod;

attaching an eccentric lever to the connecting rod eccentric;

connecting a compression ratio adjustment link to the eccentric lever;

connecting a compression ratio adjustment mechanism to the compression ratio adjustment link; and providing a connecting rod window in the connecting rod through which the eccentric lever passes.

14. The method of claim 13, further comprising the step of:

fully disposing the connecting rod eccentric between the plane defined by the first side of the connecting rod and the plane defined by the second side of the connecting rod.

15. The method of claim 13, further comprising the steps of:

connecting the compression ratio adjustment mechanism to a controller, and controlling the compression ratio adjustment mechanism with the controller.

16. The method of claim 15, further comprising the steps of:

controlling the orientation of the connecting rod eccentric by extending or retracting the compression ratio adjustment link using the compression ratio adjustment mechanism.

17. The method of claim 16, further comprising the steps of:

orienting the compression ratio adjustment link and the compression ratio adjustment mechanism on the opposite side of the crankshaft from the offset of the centerline of the eccentric external cylindrical surface with respect to the centerline of the eccentric internal bore.

18. The method of claim 17, further comprising the steps of:

increasing the compression ratio of the engine by extending the compression ratio adjustment link toward the centerline of the crankshaft, thereby causing the connecting rod eccentric to rotate upward about the crankpin by way of the eccentric lever, and raising the connecting rod and piston when at the top dead center position of the crankshaft.

19. The method of claim 17, further comprising the steps of:

decreasing the compression ratio of the engine by retracting the compression ratio adjustment link away from the centerline of the crankshaft, thereby causing the connecting rod eccentric to rotate downward about the crankpin by way of the eccentric lever, and lowering the connecting rod and piston when at the top dead center position of the crankshaft.

20. The method of claim 13, wherein:

the compression ratio adjustment mechanism further comprises a crank that is rotated in order to extend or retract the compression ratio adjustment link.

* * * * *